US005094505A

United States Patent [19]

Nichols

[11] Patent Number: 5,094,505

[45] Date of Patent: Mar. 10, 1992

[54] COMBINATION STEP-STOOL-SEAT

[75] Inventor: Khipra Nichols, Rumford, R.I.

[73] Assignee: Playskool Baby, Inc., Pawtucket, R.I.

[21] Appl. No.: 682,530

[22] Filed: Apr. 5, 1991

[51] Int. Cl.[5] ..... A47C 7/62; A47C 31/00

[52] U.S. Cl. ..... 297/118; 297/217; 297/378; 182/33.3

[58] Field of Search ..... 297/118, 129, 125, 127, 297/217, 378; 182/33, 33.3, 33.4

[56] References Cited

U.S. PATENT DOCUMENTS

| | | | |
|---|---|---|---|
| 1,671,013 | 5/1928 | Conners . | |
| 1,723,938 | 8/1929 | Ireland . | |
| 2,024,960 | 12/1935 | Allerding . | |
| 2,584,642 | 2/1952 | Tuttle . | |
| 2,666,210 | 1/1954 | Wiley | 297/118 |
| 2,705,994 | 4/1955 | Stattler | 297/378 |
| 3,075,610 | 1/1963 | Lubke . | |
| 3,367,712 | 2/1968 | Greene | 182/33.3 |
| 3,530,954 | 9/1970 | Schmidt | 297/118 |
| 3,650,351 | 3/1972 | Schmidt | 182/53.3 |
| 3,736,023 | 5/1973 | Lyons . | |
| 3,773,329 | 11/1973 | Secter . | |
| 4,258,827 | 3/1981 | Klose . | |
| 4,557,350 | 12/1985 | Wang . | |
| 4,645,261 | 2/1987 | Bourne et al. . | |

*Primary Examiner*—Kenneth J. Dorner
*Assistant Examiner*—James M. Gardner
*Attorney, Agent, or Firm*—Salter & Michaelson

[57] ABSTRACT

A combination step-stool-seat includes first and second members which are pivotally connected for movement between a first position wherein the first and second members are operative as the bottom and seat back portions, respectively, of a child's booster seat, and a second position wherein the first and second members are operative as first and second steps, respectively, of a stepstool. The first and second members are preferably individually molded from a plastic material and when they are in the second positions thereof the step-stool-seat is relatively compact and portable.

5 Claims, 2 Drawing Sheets

COMBINATION STEP-STOOL-SEAT

BACKGROUND AND SUMMARY OF THE INVENTION

The instant invention relates to convertible furniture for children, and more particularly to a combination step-stool-seat for a child.

It has been found that it can be important during the early stages of child development for a child to gain an appreciation for dining with other family members. Hence, a number of booster seats, high chairs, stools, and other similar other devices have been developed over the years for enabling young children to be more effectively seated at, or adjacent to, dining tables. It has also been found that the versatility of a child seating apparatus of this type can be significantly enhanced by adapting it for alternative use as a step stool, step ladder, or the like. However, while a number of the heretofore available convertible seating apparatus have been adapted for alternative use as step stools, etc., they have generally been of relatively complex, bulky construction, and for this reason they have often been found to be impractical, and not readily transportable.

Heretofore available seating apparatus representing the closest prior art to the subject invention of which the applicant is aware are disclosed in the CONNERS U.S. Pat. No. 1,671,013; IRELAND U.S. Pat. No. 1,723,938; ALLERDING U.S. Pat. No. 2,024,960; TUTTLE U.S. Pat. No. 2,584,642; LUBKE No. 3,075,610; LYONS U.S. Pat. No. 3,736,023; SECTOR U.S. Pat. No. 3,773,329; KLOSE U.S. Pat. No. 4,258,827; WANG U.S. Pat. No. 4,557,350; BOURNE ET AL U.S. Pat. No. 4,645,261. However, in general the devices disclosed in these references are of relatively complex construction and not readily portable. Consequently, despite the existence of numerous heretofore available child seating apparatus there is a recognized need for an effective and simple child seating apparatus which is readily and easily convertible for alternative use as a step stool.

The instant invention provides an effective child seating apparatus which is readily convertible for use as a step stool. More specifically, the combination step-stool-seat of the instant invention comprises first and second pivotally connected members which are preferably each integrally molded from a suitable durable plastic material and which are pivotally connected so that they are readily and easily hingeable between a first position wherein the first and second members cooperate to define a step stool, and a second position wherein they cooperate to define a booster seat. The first member includes spaced upper and lower walls and front and rear ends, and the front portion of the first member has a seating recess formed therein which opens upwardly through the upper wall and forwardly through the front end. The first member further includes a rear portion which extends rearwardly from the rear extremity of the recess to the rear end, and the rear portion of the upper wall of the first member is preferably formed as a stepping surface. The second member includes spaced first and second main walls, and first and second walls, and at least a portion of the first main wall of the second member is formed as a second stepping surface. The combination step-stool-seat further includes means pivotally attaching the second member to the first member so that the second member is pivotable between a first position wherein the first and second members cooperate to define a step stool, and a second position wherein the first and second members cooperate to define a booster seat. More specifically, the second member is attached to the first member so that when the second member is in the first position thereof the second member is received substantially entirely on the front portion of the first member so that the second main wall of the second member faces the seating recess in the first member, and so that the second stepping surface is disposed in substantially parallel, upwardly spaced, forwardly offset relation to the first stepping surface. The second member is further pivotally attached to the first member so that when the second member is in the second position thereof the second member is received substantially entirely on the rear portion of the first member so that the second end wall of the second member faces the upper wall of the first member, and the second main wall of the second member extends upwardly from the first member adjacent the rear extremity of the seating recess. The means pivotally attaching the second member to the first member is preferably operative for pivotally attaching the second member to the first member along an axis which is adjacent the rear extremity of the seating recess and spaced downwardly slightly from the first main wall of the second member. The second member preferably includes a seat back portion of reduced width, and the second main wall of the second member is preferably formed as a concave seat back surface which extends upwardly from the first member adjacent the rear extremity of the recess when the second member is in the second position thereof. The second member is preferably further formed so that the seat back portion of reduced width thereof is received in the seating recess in the first member when the second member is in the second position thereof. Further, the second member is preferably dimensioned and configured to be received in substantially aligned relation on the forward portion of the first member when the second member is in the first position thereof and to be received in substantially aligned relation on the rear portion of the first member when the second member is in the second position thereof.

It has been found that the combination step-stool-seat of the instant invention can be effectively utilized as either a step stool or a seat, and that it is readily and easily movable between the first and second positions thereof, and highly portable. In this connection, because of the simple construction of the combination step-stool-seat of the instant invention it can be effectively moved between the first and second positions thereof with a simple pivoting movement. Further, because of the unique relationship between the first and second members, the combination step-stool-seat of the instant invention is readily and easily portable, particularly when it is in the first position thereof.

Accordingly, it is a primary object of the instant invention to provide an effective combination step-stool-seat for a child.

Another object of the instant invention is to provide a combination step-stool-seat which is readily and easily movable between first and second positions thereof for alternative use as a step stool or as a seat, respectively.

Another object of the instant invention is to provide an effective combination step-stool-seat which is readily and easily portable.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
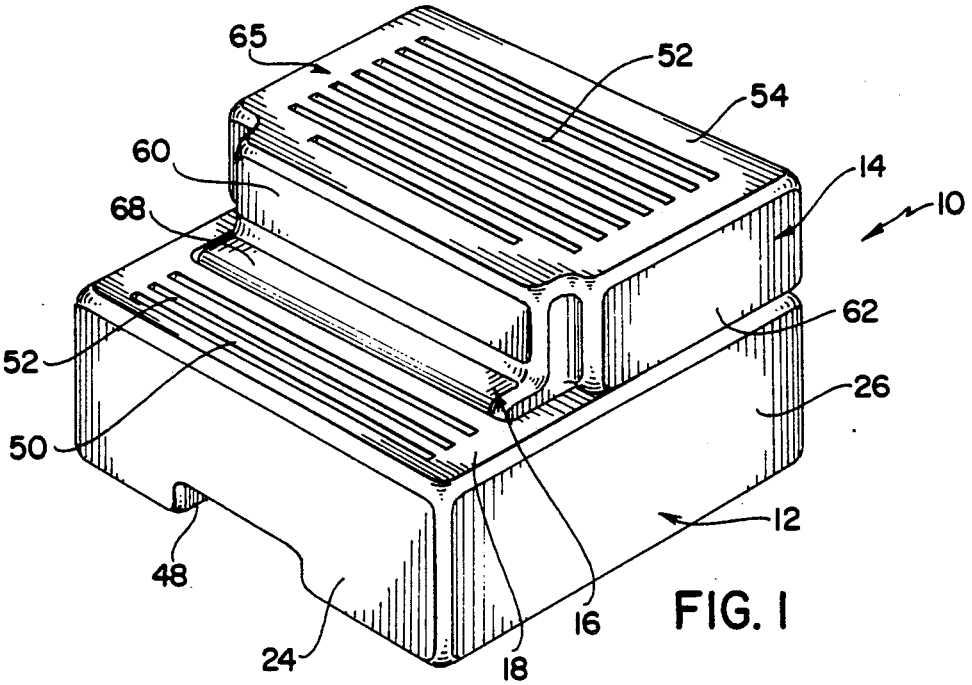
FIG. 1 is a perspective view of the combination step-stool-seat of the instant invention in the first position thereof.
Figure 2:
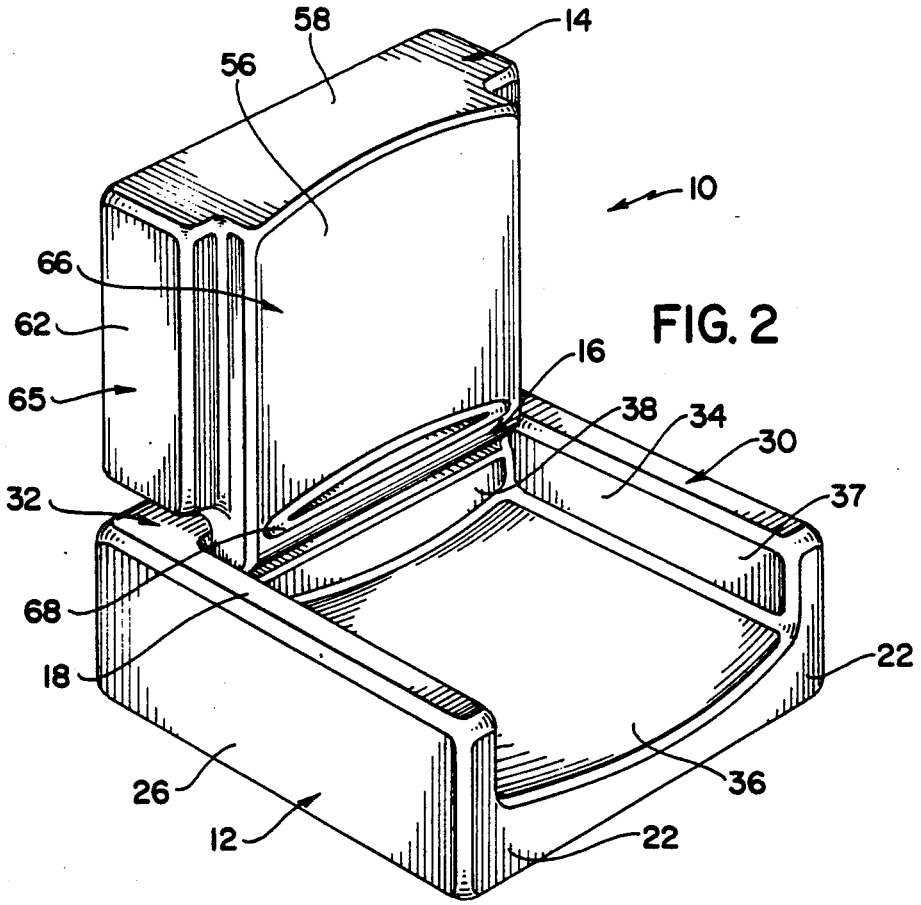
FIG. 2 is a perspective view thereof in the second position thereof.
Figure 3:
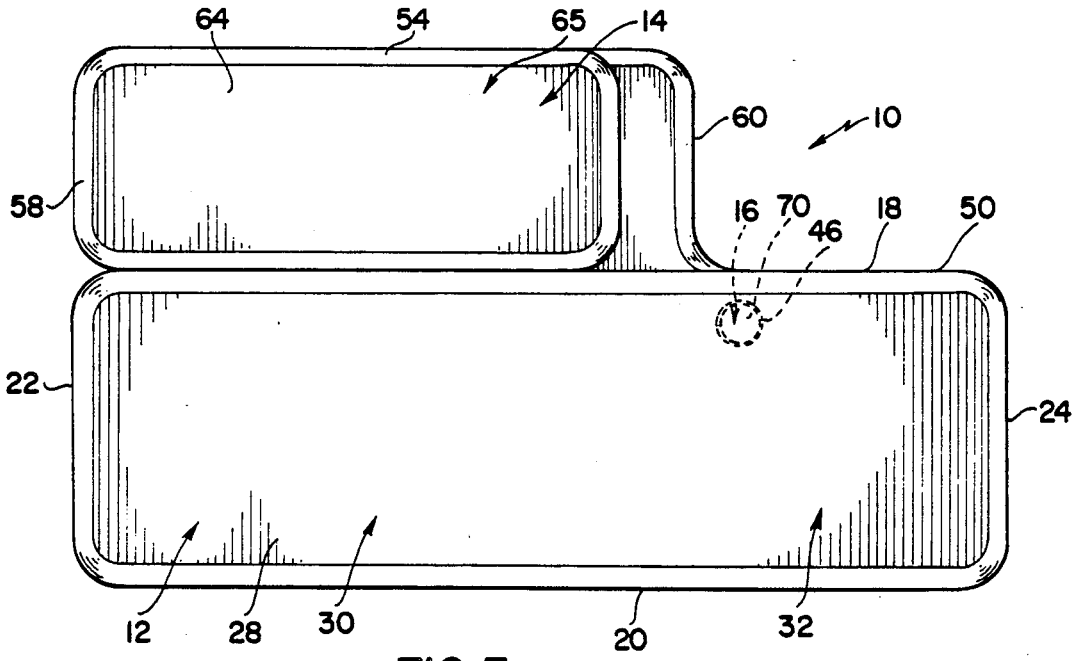
FIG. 3 is a side elevational view thereof in the first position thereof.
Figure 4:
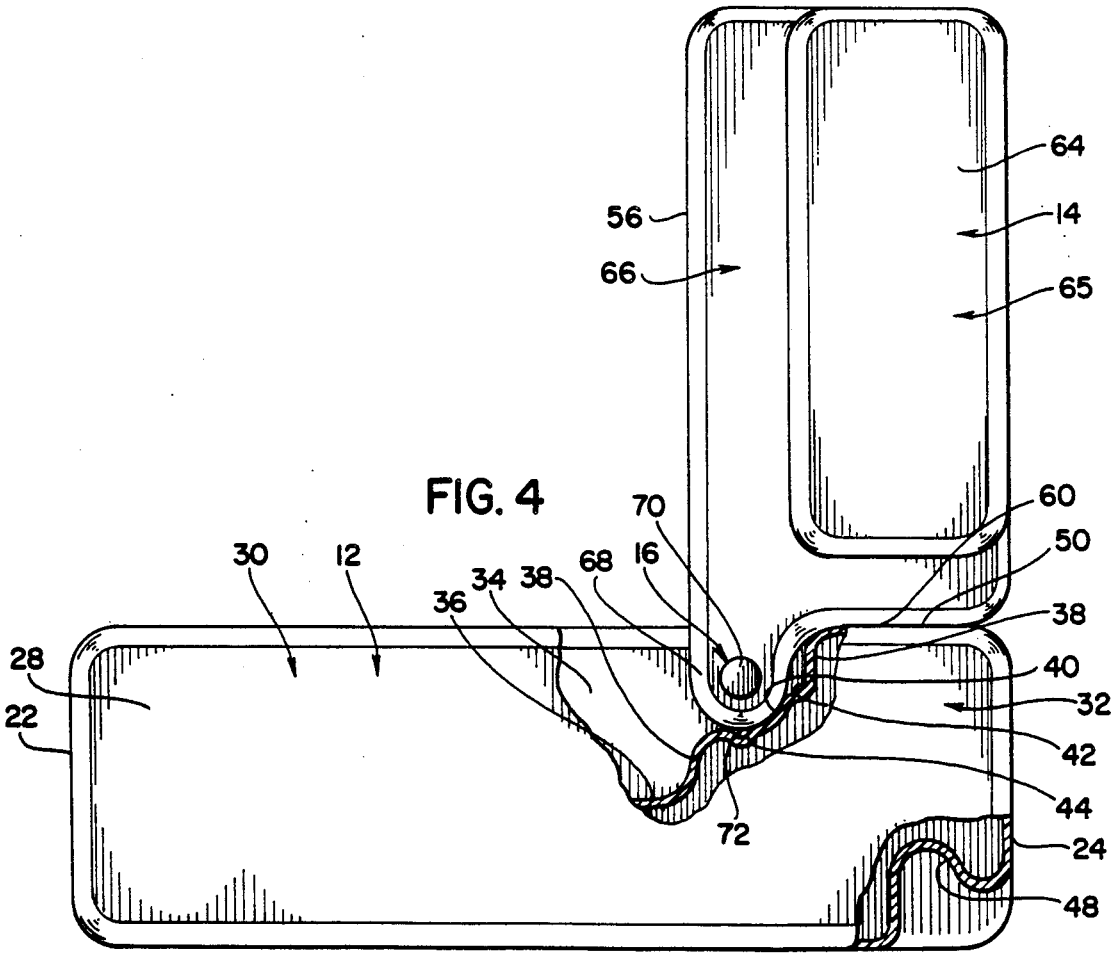
FIG. 4 is a side elevational view thereof in the second position thereof with portions of the first member illustrated in section.

Referring now to the drawings, the combination step-stool-seat of the instant invention is illustrated and generally indicated at 10 in FIGS. 1 through 4, and it comprises a first member generally indicated at 12 and a second member generally indicated at 14. The second member 14 is pivotally attached to the first member 12 by means of a pivot assembly generally indicated at 16 for enabling the second member 14 to be pivoted between the first position thereof illustrated in FIG. 1, and the second position thereof illustrated in FIG. 2, for alternative use of the combination step-stool-seat 10 as a step stool, or as a booster seat, respectively.

The first member 12 is preferably integrally molded from a suitable durable rigid plastic material and it includes upper and lower walls 18 and 20, respectively, front and rear ends 22 and 24, respectively, and left and right side walls 26 and 28, respectively. The first member 12 includes a front portion generally indicated at 30, a rear portion generally indicated at 32, and a seating recess 34 is formed in the front portion 30 so that it opens upwardly through the top wall 18, and forwardly through the front wall 22. The recess 34 includes a slightly concave bottom seating surface 36, a pair of spaced opposite side walls 37 and a rear surface 38 which defines the rear extremity of the recess 34. The rear portion 32 extends rearwardly from the rear surface 38 of the recess 34 to the rear wall 24, and a recess or channel 40 is formed in the forward portion of the rear portion 32 adjacent the rear surface 38. Formed in the interior of the channel 40 are first and second spaced substantially parallel detent notches 42 which extend for short distances in substantially parallel relation to the rear surface 38. A pair of sockets 46 are formed in the first member 12 adjacent opposite ends of the channel 40 for pivotally mounting the second member 14 on the first member 12 as will hereinafter be more fully set forth. A carrying handle recess 48 is formed in the rear portion 32 along the intersection between the bottom wall 20 and the rear wall 24, and a upwardly facing first stepping surface 50 is also formed in the rear portion 32. The stepping surface 50 preferably includes a plurality of integrally molded treads 52, and it is preferably formed as a portion of the upper wall 18.

The second member 14 is preferably integrally molded with the pivot assembly 16 from a suitable durable rigid plastic material. The second member 14 includes spaced substantially parallel first and second main walls 54 and 56, respectively, spaced first and second end walls 58 and 60, respectively, and spaced first and second side walls 62 and 64, respectively. The second member 14 includes an enlarged main portion generally indicated at 65, and a reduced seat back portion generally indicated at 66. The second main wall 56 is preferably formed as a slightly concave seat back surface and it is preferably formed as part of the reduced seat back portion 66. The reduced seat back portion 66 is dimensioned so that it is receivable in the recess 34 for positioning the second member 14 in the first position thereof illustrated in FIGS. 1 and 3, and the enlarged main portion 65 is preferably formed so that it is receivable in substantially aligned relation on the forward portion 30 of the first member 12 for positioning the second member 14 in the first position thereof. The first main wall 54 of the second member 14 is preferably formed as a second stepping surface, and it preferably also has a plurality of treads 52 integrally molded therein.

The pivot assembly 16 includes a pivot extension portion 68 which extends integrally from the second member 14 along the second end wall 60, and a pair of pivot pins 70 which extend outwardly from opposite ends of the extension portion 68. Also formed on the extension portion 68 is a detent rib 72. The pivot assembly 16 is adapted to be assembled with the first member 12 so that the pivot pins 70 are received in the sockets 46, and so that the extension portion 68 is received in the recess 40. Further, when the pivot assembly 16 is assembled with the first member 12 in this manner the detent rib 70 is alternatively receivable in either the detent channel 42 or the detent channel 44 for releasably securing the second member 14 in the first position thereof or the second position thereof, respectively. Accordingly, the pivot assembly 16 is operative for pivotally securing the second member 14 to the first member 12 so that the second member 14 is pivotable between the first position thereof illustrated in FIGS. 1 and 3, wherein the seat back surface 56 faces the bottom seating surface 36 of the recess 34, and the enlarged main portion 65 rests on the top wall 18 and the second position thereof illustrated in FIGS. 2 and 4, wherein the second end wall 60 is received on the top wall 18 in the rear portion 32 of the first member 12, and the second main wall 56 extends upwardly from the rear extremity 38 of the recess 34. As will be seen, when the second member 14 is in the first position thereof the main portion 65 of the second member 14 is received in substantially aligned relation on the front portion 30 of the first member 12. Further, when the second member 12 is in the second position thereof the second member 14 is received in substantially aligned relation on the rear portion 32 of the first member 12.

It is seen therefore that the instant invention provides an effective combination step-stool-seat. The step-stool-seat 10 is effectively pivotable between the first and second positions thereof for alternative use as a step stool or as a seat. Further, the overall construction of the step stool seat 10 is relatively simple and the step stool seat 10 is sufficiently compact and portable to make it highly practical. Accordingly, it is seen that the step-stool-seat 10 represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A combination step-stool-seat comprising:

a. a first member having spaced upper and lower walls and spaced front and rear end walls, said first member including front and rear portions which include said front and rear end walls thereof, respectively, said front portion having a seating recess formed therein which open upwardly through said upper wall and forwardly through said front end wall, said recess having a bottom seating surface and having a rear extremity which is spaced forwardly from said rear end wall, said rear portion extending from said rear extremity to said rear end wall and including an upwardly facing first stepping surface which is spaced upwardly from said lower wall of said first member;

b. a second member having spaced opposite first and second main walls and first and second end walls, the first main wall of said second member including a second stepping surface; and c. means pivotally attaching said second member to said first member so that said second member is pivotable between a first position wherein the latter is received substantially entirely on said front portion of said first member so that the second main wall of said second member faces the bottom seating surface of said recess and said second stepping surface is in substantially parallel, upwardly spaced forwardly offset relation to said first stepping surface, and a second position wherein said second member is received substantially entirely on said rear portion of said first member so that the second end wall of said second member faces the upper wall of said first member, and the second main wall of said second member extends upwardly from said first member adjacent said rear extremity to permit the use of said second member as a seat back.

2. In the combination step-stool-seat of claim 1, said means pivotally attaching said second member to said first member further characterized as pivotally attaching said second member to said first member adjacent said rear extremity of said seating recess.

3. In the combination step-stool-seat of claim 1, the second main wall of said second member including a concave seat back surface which extends upwardly from said first member adjacent said rear extremity of said recess when said second member is in the second position thereof.

4. In the combination step-stool-seat of claim 2, said means pivotally attaching said second member to said first member further characterized as pivotally attaching said second member to said first member along a pivot axis which is spaced downwardly slightly from the upper wall of said first member, said second member including a main portion and a seat back portion of reduced width, the second main wall of said second member being formed as a concave seat back surface and being located on said seat back portion, said seat back portion of reduced width being received in said recess when said second member is in said second position thereof.

5. In the combination step-stool-seat of claim 4, said main portion of said second member being dimensioned and configured to be received in substantially aligned relation on said forward portion when said second member is in said first position thereof, said second member being further dimensioned and configured to be received in substantially aligned relation on said rear portion when said second member is in said second position thereof.

* * * * *